US006290834B1

(12) United States Patent
Pearsall

(10) Patent No.: US 6,290,834 B1
(45) Date of Patent: Sep. 18, 2001

(54) CERAMIC COATED LIQUID TRANSFER ROLLS AND METHODS OF MAKING THEM

(75) Inventor: Thomas J. Pearsall, Summerfield, FL (US)

(73) Assignee: Ceramic Coatings Technologies, Inc., Palm City, FL (US)

( * ) Notice: Subject to any disclaimer, the term of this patent is extended or adjusted under 35 U.S.C. 154(b) by 0 days.

(21) Appl. No.: 09/548,095

(22) Filed: Apr. 12, 2000

(51) Int. Cl.[7] ..... C25D 5/34
(52) U.S. Cl. ..... 205/205; 205/120; 205/220
(58) Field of Search ..... 205/220, 102, 205/205

(56) References Cited

U.S. PATENT DOCUMENTS

| | | | |
|---|---|---|---|
| 3,832,293 | 8/1974 | Hradcovsky et al. | 204/56 R |
| 3,834,999 | 9/1974 | Hradcovsky et al. | 204/56 R |
| 3,891,516 | 6/1975 | Chu | 204/33 |
| 3,956,080 | 5/1976 | Hradcovsky et al. | 204/56 R |
| 4,082,626 | 4/1978 | Hradcovsky | 204/56 R |
| 4,184,926 | 1/1980 | Kozak | 204/32 R |
| 4,592,958 | 6/1986 | Mosser et al. | 428/432 |
| 4,659,440 | 4/1987 | Hradcovsky | 204/58 |
| 4,794,680 | 1/1989 | Meyerhoff et al. | 29/132 |
| 4,869,789 | 9/1989 | Kurze et al. | 204/56.1 |
| 4,960,050 | 10/1990 | Hatch | 101/348 |
| 5,069,763 | 12/1991 | Hradcovsky | 205/326 |
| 5,089,683 | 2/1992 | Stephenson et al. | 219/121.78 |
| 5,093,180 | 3/1992 | Morgan | 428/156 |
| 5,143,578 | 9/1992 | Luthi | 156/643 |
| 5,147,515 | 9/1992 | Hanagata et al. | 204/164 |
| 5,221,562 | 6/1993 | Morgan | 427/555 |
| 5,236,763 | 8/1993 | Luthi | 428/156 |
| 5,275,713 | 1/1994 | Hradcovsky | 205/106 |
| 5,385,662 | 1/1995 | Kurze et al. | 205/316 |
| 5,616,229 | 4/1997 | Samsonov et al. | 205/107 |
| 5,720,866 | 2/1998 | Erokhine et al. | 205/83 |
| 5,840,386 | 11/1998 | Hatch et al. | 428/36.9 |
| 5,857,950 | 1/1999 | Hycner | 492/30 |

*Primary Examiner*—Kathryn Gorgos
*Assistant Examiner*—Thomas H Parsons
(74) *Attorney, Agent, or Firm*—William L. Krayer

(57) ABSTRACT

Liquid transfer rolls such as printing rolls are made by imposing a hard ceramic coating on an incipient liquid transfer roll in an electrolytic bath subjected to a modified shaped wave alternating current, which causes dielectric breakdown and the formation of a hard ceramic coating on the roll. The roll is laser engraved to form liquid carrying reservoirs or cells on the surface of the roll, either before or after the ceramic coating is built on the roll.

19 Claims, No Drawings

CERAMIC COATED LIQUID TRANSFER ROLLS AND METHODS OF MAKING THEM

BACKGROUND OF THE INVENTION

1. Field of the Invention

This invention relates to the manufacture of liquid transfer rolls such as ceramic coated printing rolls, and particularly to hard engraved or embossed surfaces on aluminum and other metal rolls used for transferring liquid such as ink in printing.

2. Description of the Related Art

It is a well established and accepted practice in the printing industry, and in other industries where process materials such as ink, varnish, and adhesives are transferred from one surface to another, to apply ceramic coatings to liquid carrier rolls fabricated from aluminum, steel and other suitable materials. Very hard and wear-resistant ceramic coatings such as refractory oxides or metallic carbides may be applied by thermal spray technologies. After application of the thermal sprayed coating, the roll surface is ground and/or polished to a very smooth finish and then engraved with a high power laser to create "inkwells" or cell patterns in the coating. These cells carry the printing ink or other liquid process materials. Such coatings have virtually revolutionized the printing industry over the past two decades. These ceramic coatings enable the transfer rolls to withstand the wear generated by the continuous scraping of a steel knife (doctor blade) utilized to maintain a uniform film of the liquid being transferred on the roll's surface. The ceramic coatings are equally advantageous in the transfer of adhesives, varnish and other liquids.

The thermal spray processes rely on the introduction of fine particles of the preferred ceramic into a high energy, high temperature gas stream. The powder particles are heated to plasticity and propelled onto the surface to be coated where they impact and form a mechanical bond with the substrate. Additional layers of the coating are applied until the desired coating film thickness has been achieved. Precision grinding and polishing techniques are then employed to create a smooth, dimensionally stable coating. Liquid transfer rolls are engraved at this point with laser equipment to form the ink-carrying (or other liquid-carrying) cells. To make a cell, the laser partially melts and vaporizes the ceramic coating it contacts at a discrete point or line to create an open channel, cell or hole, which becomes an inkwell (or container for other liquid). A by-product of the laser activity is a semi-molten slag, similar to volcanic lava, which forms around the hole and re-solidifies. It appears that this phenomenon occurs because the thermal spray coating consists of individual powder particles, some of which are not fully plasticized. This is the nature of the thermal spray process. The re-solidified ceramic is very hard and brittle. When the process roll is placed into service, pieces of the brittle ceramic can break off and become embedded in the roll surface or in the steel doctor blade. An embedded piece of hard ceramic can scratch or cut a groove in the working surface of the roll in a very short period of time, destroying the quality of the roll face and necessitating its replacement. The embedding problem has become more and more frequent as the cells have become smaller with the ever-increasing demand for higher print quality.

A second shortcoming of the thermal sprayed ceramic coating is that a roughened surface remains in the cell after the laser engraving operation. This rough surface makes cleaning of the roll (removal of ink or other material) extremely difficult and time consuming. Valuable time is lost and it is not uncommon to damage the cells during the cleaning process.

A desirable improved process would be one which has little or no ceramic re-melt or liquid flow on application of the laser to cut the ink-well patterns. Additionally, a desirable process would leave holes or cells having sharply defined patterns, having walls which are smooth and of the same texture as the surrounding area, to facilitate ink (and other material to be transferred) removal and cleanup as well as more precise patterns. Easier cleanup increases productivity and minimizes the chances of damage to the roll surface. And, a desirable process would be one which does not demonstrate a significant shortcoming of the thermal spray processes—the sometimes inadequate adherence of the coating to the roll substrate. This is an inherent difficulty with the thermal spray processes particularly for substrates, such as aluminum, having coefficients of thermal expansion considerably different from the ceramic coating.

Further, it would be desirable to have a process wherein the laser-produced cell patterns are imparted to the roll surface prior to application of the ceramic coating rather than after, since application of the laser after coating incorporates all the above possible defects and shortcomings, and results in vertical surfaces in the cells which are different in composition from the horizontal surfaces. Coating after engraving is not feasible with sprayed ceramics.

The reader will be interested in the disclosure of U.S. Pat. No. 5,616,229 to Samsonov and Hiterer, which proposes the formation of ceramic coatings of up to 300 microns within about 90 minutes through the use of an alternating current of at least 700 volts having a shaped wave (not the conventional sinusoidal form) which rises from zero to its maximum height and falls to below 40% of its maximum height within less than a quarter of its full alternating cycle, thereby causing dielectric breakdown, the alternating current being imposed on an electrolytic bath in which the metal subject is an electrode, the bath comprising initially an alkali metal hydroxide and in a later step including an oxyacid salt of an alkali metal, such as sodium tetrasilicate. While the '229 patent speaks of forming coatings on aluminum surfaces, the authors do not treat the possible use of such a coating process for the manufacture of aluminum process rolls, where the coating step is integrated with a laser system to engrave or emboss a three-dimensional pattern for holding liquid.

Laser engraving of hard-coated rolls is described in U.S. Pat. Nos. 4,794,680, 5,089,683, 5,093,180, and 5,143,578, which are incorporated herein, in their entirety, by reference.

SUMMARY OF THE INVENTION

My invention combines the use of laser embossing and/or engraving systems with the formation of hard ceramic layers on aluminum-based printing and other process rolls. The engraving or embossing step may be used either before or after the coating is formed on the aluminum roll. In either case, the oxide ceramic coatings utilized according to this invention on the surface of process rolls exhibit surface hardnesses of at least 1000 $Kn_{100}$ and preferably 1300 $Kn_{100}$ or more, and a density greater than 90% of theoretical, preferably greater than 97%, and a surface roughness after finishing of less than 8 micro-inches Ra, preferably less than about 4 micro-inches. In addition to the process described in the above-mentioned Samsonov U.S. Pat. No. 5,616,229, such hardnesses and densities may be achieved by the methods described by Hradcovsky in U.S. Pat. Nos.4,659, 440 and 5,069,763, Hanagata U.S Pat. No. 5,147,515, and Erokhine et al. U.S. Pat. No. 5,720,866, all of which are incorporated herein in their entireties by reference. I may use any method of forming a hard surface on an aluminum roll; metals other than aluminum are also useful in my invention; particularly rolls fabricated from titanium, magnesium, beryllium, hafnium, zirconium, and alloys of these with or without aluminum, having coatings of the hardnesses and densities described above.

Whether the engraving step is performed before coating or after, in a preferred method I use a modified shaped-wave electrolytic process to form a hard coating on the process roll. The process may use the teachings of U.S. Pat. No. 5,616,229 and accordingly that patent is hereby incorporated by reference, in its entirety, into this disclosure. However, the '229 patent uses two distinct electrolytic baths for the substrates discussed, and I have found it is not necessary to do so for liquid transfer rolls, particularly of aluminum.

My method comprises engraving, preferably by laser, a three-dimensional pattern on an incipient liquid transfer roll, and forming a hard coating on the incipient liquid transfer roll by immersing it first in an electrolytic bath comprising (deionized) water, an alkali metal salt or hydroxide (preferably potassium hydroxide) as an electrolytic agent, at a concentration of 0.5–7 grams per liter, and, as a passivating agent, a colloidal suspension of sodium silicate in the form $Na_2O.xSiO_2$ (x=>2.55 by weight) at a concentration of 2.0–9.5 grams per liter while conducting through the bath a modified shaped-wave alternating electric current from a source of at least 250–800 volts through the surface of the incipient liquid process roll. The modified shaped-wave electric current rises from zero to its maximum height and falls to below 40% of its maximum height (amplitude) within less than a quarter of a full alternating cycle, thereby causing dielectric breakdown and the formation of a compact ceramic film on the roll surface.

In another version of my invention, a hard wear resistant ceramic coating is formed on an incipient process roll having a blank metal surface by immersing it in an selectrolytic bath comprising (deionized) water, an electrolytic agent comprising an alkali metal salt or hydroxide (preferably potassium hydroxide) at a concentration of 0.5–7 grams per liter, and, as a passivating agent, a colloidal suspension of sodium silicate in the form $Na_2O.xSiO_2$ (x=>2.55 by weight) at a concentration of 2.0–9.5 grams per liter while conducting through the bath a modified shaped-wave alternating electric current from a source of at least 250–800 volts through the surface of the incipient printing (process) roll. The modified shaped-wave electric current rises from zero to its maximum height and falls to below 40% of its maximum height within less than a quarter of a full alternating cycle, thereby causing dielectric breakdown and the formation of a compact ceramic film on the roll surface. I then remove the roll from the bath, grind or polish the formed ceramic coating to a suitably smooth finish, and engrave or emboss its surface, preferably by laser, to impose a three-dimensional pattern on the ceramic coating surface of the roll.

Terms

Throughout this specification, I use the term "liquid transfer roll" to mean a roll designed and manufactured to carry liquid on its surface and transfer it to another surface. As described above, liquid transfer rolls have small depressions or cells placed on their surfaces, or channels, which serve as miniature reservoirs for liquid. The cells may have various shapes and are typically made by laser beams. See U.S. Pat. Nos. 5,093,180 and 5,221,562 for descriptions of liquid transfer rolls made by laser engraving a hard-surface roll. A common type of liquid transfer roll is a printing roll. In some passages in the present specification, I may refer to a liquid transfer roll as simply a process roll. The liquid process roll may be in the form of a tube, and the term "liquid process roll" is used herein to include a tube or a sleeve having a cylindrical surface for placement over a base or holder of any suitable geometry or material.

Surface roughness measurements described herein in Ra units reflect the average surface roughness measured in micro-inches according to ANSI Method B46.1.

DETAILED DESCRIPTION OF THE INVENTION

The electrolytic treatment of the incipient liquid transfer roll will generally take about 30 to about 240 minutes to form a ceramic coating of 25 to 300 microns (0.001 to 0.012 inch) thick. A preferred thickness for the coating is 100 to 200 microns (0.004 to 0.012 inch) thick. Where the roll is aluminum, during the process cycle the substrate temperature is preferably maintained at less than 60° C. (140° F.). The incipient blank liquid transfer roll will preferably have an aluminum surface, but it may be made of aluminum, magnesium, titanium, zirconium, beryllium, hafnium or alloys thereof.

The coating process can utilize a single electrolytic bath comprising water and a solution of an alkali metal hydroxide concentrated at 0.5 to 2 grams per liter, a second bath containing water, a solution of alkali metal hydroxide (0.5 to 2 grams per liter) and a low concentration (1 to 2 grams per liter) of sodium tetrasilicate, and a third bath containing water, an alkali metal hydroxide concentrated at 0.5 to 5 grams per liter and a 1 to 5 grams per liter concentration of sodium tetreasilicate.

However, a preferred method of coating is to utilize a single bath wherein the electrolyte solution comprises deionized water, potassium hydroxide concentrated at 0.5 –7 grams per liter and a colloidal suspension of sodium silicate in the form $Na_2O.xSiO_2$ (x=>2.55 by weight). The roll to be coated comprises one electrode and the container for the electrolyte comprises the other electrode. A modified shaped-wave charge of at least 250 volts is passed through the surface of the incipient roll causing dielectric breakdown and formation of a compact ceramic film on the surface of the roll. The ceramic thus formed comprises aluminum and silicon oxides the composition (oxide content and proportions of Al and Si) of which may vary somewhat as influenced by the substrate metal and the conditions of formation.

Voltages greater than 800 are unnecessary to the formation of the ceramic and voltages in excess of 800 are not recommended because they will overheat the electrolytic solution. Voltages less than 250 are not recommended because uniform breakdown of the electrolyte will not occur and film growth rates will not be efficient or uniform. Amperages and cycles are more or less conventional—100 amperes per square foot of treated surface is adequate and 50–70 cycles per second is satisfactory.

The electrolytic fluid is an aqueous solution comprising 2 to 60 or more grams per liter, preferably 2 to 15 grams per liter, of a passivating agent comprising a soluble silicate, polyphosphate, chromate, molybdate, vanadate, tungstate or aluminate salt, the preferred passivating agent being sodium silicate ($Na_2SiO_3$) in the form of a colloidal suspension, and, as an electrolytic agent, 0.5 to 3 grams per liter of a strong acid, strong alkali or strong acid or alkaline salt; suitable electrolytic agents are $H_2SO_4$, KOH, NaOH, NaF, $Na_2SO_4$, $H_3PO_4$, and $NaPO_4$, the preferred electrolytic agent being KOH. Any known or commercially used passivating agent may be used, such as $Na_2SiO_3$, $K_2SiO_3$, $Na_6P_6O_{18}$, $Na_2Cr_2O_2$, $Na_2Cr_2O_7$, $Na_2Mo_2O_7$, $K_2Cr_2O_7$, $Na_2V_2O_7$, $K_2V_2O_7$, $Na_2WO_4$, $K_2WO_4$ and $KAlO_2$.

A laser engraving process is preferred for placing the desired cell pattern on the coated surface of the roll. Process rolls so engraved or embossed are utilized to distribute, among other materials, printing inks, hot melts, cold seals, and overvarnishes. Additionally, continuous designs including woodgrain patterns, wall coverings and specialty applications are achievable. Engraving patterns are achievable to improve laydown of waterborne inks and coatings as well as solvents. Honeycomb configurations used in flexographic printing and coating applications are readily produced in the ceramic coating of this invention as are hexagonal, diamond, square or channel cell shapes. Typically the depth of the "inkwells" or cells will be on the order of 50–75 microns (0.002 to 0.003 inch); thus, where the coating is already on the roll, the cells will not be made deeper than the thickness of the coating. When the coating is placed on the roll after the laser engraving, the engraving dimensions need not be calculated to allow for a thick coating on top of the engraved surface in three dimensions, because, as indicated above, the fully formed coating will in most cases not protrude beyond the original dimensions—that is, the coating will not add to the diameter of the roll.

Following is an exemplary procedure for the manufacture of a liquid transfer roll by first placing the ceramic coating on a roll and then engraving it with a laser.

Procedure 1

Fabrication of the starting process roll is accomplished in accordance with conventional machining and/or grinding practices to at or near the final dimensions specified. The substrate material is preferably aluminum, but may be titanium, magnesium, hafnium, zirconium, beryllium or alloys thereof. In some cases it may be feasible to fabricate a sleeve from any of these metals to be fitted to a process roll originally fabricated from other materials such as steel or other base material.

The fabricated roll or sleeve is cleaned of surface contaminants by any suitable method.

The fabricated roll or sleeve is attached to a fixture or mechanism such that it may be immersed in an aqueous electrolyte bath containing an electrolytic agent and a passivating agent. The mechanism positions the process roll in the electrolyte and is connected to an alternating current voltage source. The bath container is connected to the voltage source such that a modified shaped-wave electric current of at least 250 volts is conducted through the surface of the process roll, causing dielectric breakdown and the formation of a compact oxide ceramic film on the roll surface. The process roll or sleeve remains in the electrolyte, connected to the voltage source, for a predetermined time period, usually from about 30 minutes to about 240 minutes, sufficient to allow formation of an oxide ceramic film of from 25 microns (0.001 inch) to 300 microns (0.012 inch) thick. Formation of the oxide ceramic film does not substantially increase the dimension of the process roll.

Upon completion of the coating formation cycle, the process roll or sleeve is removed from the electrolyte container, fixturing mechanisms are removed and the process roll or sleeve is subjected to grinding or polishing techniques well known to those skilled in the art of finishing ceramic coatings and/or materials such that a suitably smooth finish of about 12 micro-inches Ra, preferably less than 8 micro-inches Ra, is achieved. The surface finish may be enhanced to less than 4 micro-inches Ra utilizing microfinishing (also known as superfinishing) techniques such as continuously moving a film backed diamond tape over the surface of the roll, that might be rotated continuously, until the value is achieved.

Having achieved a surface roughness value of about 12 micro-inches Ra or less on the oxide ceramic surface, the process roll or sleeve may be laser engraved according to practices will known to those skilled in the techniques of laser engraving oxide ceramic coatings (U.S. Pat. Nos. 4,794,680, 5,089,683, and 5,143,578) or those disclosed in U.S. Pat. Nos. 5,093,180 and 5,221,5621, also incorporated herein by reference.

Following laser engraving of the oxide ceramic film on the process roll or sleeve, it may be desirable to again employ the microfinishing steps noted above to achieve a surface roughness value on the land areas between the inkwells or cells of 2 to 6 microinches Ra.

Following is an exemplary procedure for the manufacture of a liquid transfer roll by first engraving a blank aluminum surface roll with a laser, and then forming a hard ceramic coating on it.

Procedure 2

Fabrication of the starting process roll is accomplished in accordance with conventional machining and/or grinding practices to at or near the final dimensions specified. The substrate material is preferably aluminum, but may be titanium, magnesium, hafnium, zirconium, beryllium or alloys thereof. In some cases it may be feasible to fabricate a sleeve from any of these metals to be fitted to a process roll or other support originally fabricated from other materials such as steel or other base material.

Following fabrication and the final finishing operations, the uncoated roll or sleeve is laser engraved as described elsewhere herein to develop inkwells or cell patterns as desired in the final operating condition of the roll or sleeve. It is not necessary to substantially change the inkwell or cell dimensions to allow for the subsequent formation of the oxide ceramic film, nor is it necessary to employ laser engraving techniques that are any different than one skilled in the practice might utilize when laser engraving the desired cell configuration into a substrate material that does not have a surface film or coating applied.

The fabricated and engraved roll or sleeve is attached to a fixture or mechanism such that it may be immersed in an aqueous electrolyte bath containing an electrolytic agent and a passivating agent. Said mechanism positions the process roll or sleeve in the electrolyte and is connected to an alternating current voltage source. The bath container is connected to the voltage source such that a modified shaped-wave electric current of at least 250 volts is conducted through the surface of the process roll, causing dielectric breakdown and the formation of a compact oxide ceramic film on the roll surface. The process roll or sleeve remains in the electrolyte, connected to the voltage source, for a predetermined time period, usually from about 30 minutes to about 240 minutes, sufficient to allow formation of an oxide ceramic film of from 25 microns (0.001 inch) to 300 microns(0.012 inch) thick. Formation of the oxide ceramic film does not substantially increase the dimension of the process roll. A preferred oxide ceramic film thickness for a process roll or sleeve that has been laser engraved prior to the film application is about 50 to 75 microns (0.002 to 0.003 inch) thick.

Upon achieving the desired oxide ceramic film thickness, the process roll or sleeve is removed from the electrolyte container, fixturing mechanisms removed and the process roll or sleeve is microfinished according to the techniques and steps described herein to achieve a surface roughness of less than 12 micro-inches Ra, preferably less than 8, and most preferably about 4 micro-inches Ra or less. The preferred surface has a density of at least 95% of theoretical; see U.S. Pat. No. 5,093,180.

I prefer to perform process steps in addition to those recited above. In particular, I believe it is advantageous to perform the following steps to make a liquid transfer roll of high quality:

1. The blank roll, having a metal surface such as described above, as received from the manufacturer or after having been manufactured in house, is cleaned to remove whatever contaminants may be present on the surface;
2. The surface is converted to a ceramic by the procedure described above. During the electrolytic process, some of the aluminum or other metal on the surface is converted to an oxide such as $A1_2O_3$; some $SiO_2$ is incorporated into the surface of the roll. Temperatures at the surface during dielectric breakdown reach over 1000° F. and as high as 3000° F., and the silica is substantially welded to the aluminum oxide and the substrate. Each spark or waveform creates a spark and/or dielectric breakdown causing such high temperatures. The ceramic will tend to have a crystalline structure which will vary with the particulars of the conditions and materials used. I call the coating an "oxide ceramic" coating. It is believed the oxygen which combines with the aluminum or other substrate material is contributed by the electrolytic agent from strong acids, strong alkalis or strong salts such as $H_2SO_4$, KOH, NaOH, NaF, $Na_2SO_4$, $H_3PO_4$, and $NaPO_4$, the preferred electrolytic agent being KOH.
3. The roll is then sealed to protect against the possibility that there may be cracks or other defects in the ceramic surface which will be vulnerable to corrosion from the liquids to be transferred. I prefer to seal with an epoxy or similar sealant such as LOCTITE 12–90 which is commercially available from Loctite Corporation, Newington Conn.
4. The cylindrical shape of the roll is then checked and assured.
5. The oxide ceramic surface is then ground smooth, to a surface roughness of about 12 micro inches Ra or finer. Microfinishing (also known as superfinishing) techniques may subsequently be employed to achieve a surface finish of about 4 or less micro-inches Ra.
6. The roll is then laser engraved. Instead of melting as in the prior art, the coating will substantially evaporate, leaving clean, sharp sides on the cells.

What is claimed is:

1. Method of making a metal liquid transfer roll comprising (a) forming a hard coating on an incipient liquid transfer roll which is a roll having a blank metal surface by (i) immersing said incipient liquid transfer roll in an electrolytic bath comprising a passivating agent and an electrolytic agent, and (ii) passing a modified shaped-wave alternating electric current from a source of 250 to 800 volts through said surface of said incipient printing roll, wherein said modified shaped-wave electric current rises from zero to its maximum height and falls to below 40% of its maximum height within less than a quarter of a full alternating cycle thereby causing dielectric breakdown and the formation of a ceramic coating on said surface, removing said incipient liquid transfer roll from said electrolytic bath, and (b) engraving liquid transfer cells in said hard coating.

2. Method of claim 1 wherein step (b) is performed by laser engraving.

3. Method of claim 1 wherein said passivating agent is a colloidal silicate.

4. Method of claim 1 wherein said electrolytic agent is an alkali metal hydroxide.

5. Method of claim 1 wherein said incipient liquid transfer roll has an aluminum surface.

6. Method of claim 1 wherein step (a) is performed in a single vessel.

7. Method of claim 1 wherein step (a) is performed in at least two separate vessels.

8. Method of claim 1 wherein said passivating agent is a colloidal suspension of sodium silicate in the form $Na_2O.xSiO_2$ where x=>2.55 by weight at a concentration of 2.0–9.5 grams per liter of said bath, said electrolytic agent is an alkali metal hydroxide, said liquid transfer roll has an aluminum surface, and said engraving is done by a laser.

9. Method of claim 1 wherein said liquid transfer roll is sealed prior to engraving by coating with an epoxy coating.

10. Method of making a liquid transfer roll comprising (a) engraving liquid transfer cells on an incipient liquid transfer roll, thereby forming a liquid transfer surface on said incipient liquid transfer roll, and (b) forming a hard coating on said incipient liquid transfer roll by immersing said incipient liquid transfer roll first in an electrolytic bath comprising an electrolytic agent and a passivating agent while conducting through said electrolytic bath a modified shaped-wave alternating electric current from a source of at least 250–800 volts through said surface of said incipient printing roll, wherein said modified shaped-wave electric current rises from zero to its maximum height and falls to below 40% of its maximum height within less than a quarter of a full alternating cycle, whereby a hard liquid transfer surface is formed on said incipient liquid transfer roll.

11. Method of claim 10 wherein said incipient liquid transfer roll has an aluminum surface.

12. Method of claim 10 wherein said electrolytic agent is an alkali metal hydroxide present in a concentration of 0.5 to 2 grams/liter.

13. Method of claim 10 wherein said passivating agent comprises about 2 to about 15 grams per liter of sodium silicate of the formula $Na_2O.xSiO_2$ (x=>2.55 by weight).

14. A printing roll made by the method of claim 1.

15. A printing roll made by the method of claim 8.

16. A printing roll made by the method of claim 12.

17. A laser engraved cylindrical aluminum liquid transfer roll having an oxide ceramic surface formed after engraving.

18. A laser engraved aluminum liquid transfer roll having a surface, prior to engraving, comprising an oxide ceramic film wherein the density of the film is greater than 95% of theoretical.

19. A laser engraved cylindrical aluminum liquid transfer roll or sleeve having a surface prior to engraving comprising an oxide ceramic film wherein the hardness of the film is greater than 1000 $Kn_{100}$, said film being imparted by immersing said roll or sleeve in an electrolytic bath comprising a passivating agent and an electrolytic agent and passing a modified shaped-wave alternating electric current from a source of 250 to 800 volts through said surface of said roll or sleeve, wherein said modified shaped-wave electric current rises from zero to its maximum height and falls to below 40% of its maximum height within less than a quarter of a full alternating cycle thereby causing dielectric breakdown and the formation of a ceramic coating on said surface.

* * * * *